US008616141B2

(12) United States Patent
Gandarillas et al.

(10) Patent No.: US 8,616,141 B2
(45) Date of Patent: Dec. 31, 2013

(54) METHOD FOR DESIGNING AND CREATING MATERIAL MADE FROM FISH SKINS, WHEREIN SAID MATERIAL IS MADE FROM INDIVIDUAL FISH SKINS AND CAN BE STRETCHED, MECHANICALLY OR AUTOMATICALLY MANIPULATED, SEWN, AND IRONED TO ENSURE THAT ALL THE UNIONS AND SURFACES ARE PERFECTLY UNIFORM, FLAT, AND FREE OF RIPPLES IN ORDER TO PRODUCE A HIGHLY-TENSILE, UNIFORM CLOTH OF VARIABLE DIMENSIONS

(76) Inventors: Stiven Kerestegian Gandarillas, Puerto Varas (CL); Francisca Apparcel Daniel, Puerto Varas (CL); José Maria Rodríguez Alcalde, Santiago (CL)

( * ) Notice: Subject to any disclaimer, the term of this patent is extended or adjusted under 35 U.S.C. 154(b) by 861 days.

(21) Appl. No.: 12/648,738

(22) Filed: Dec. 29, 2009

(65) Prior Publication Data

US 2011/0017112 A1 Jan. 27, 2011

(30) Foreign Application Priority Data

Jul. 27, 2009 (CL) ..... 1654-09

(51) Int. Cl.
*D05B 23/00* (2006.01)

(52) U.S. Cl.
USPC ..... 112/475.09

(58) Field of Classification Search
USPC ..... 112/154, 441, 176, 177, 402, 475.09, 112/28; 2/65, 85, 258, 87; 428/16, 540; 8/94.15, 94.12, 94.1 R
See application file for complete search history.

(56) References Cited

U.S. PATENT DOCUMENTS

| | | | | | |
|---|---|---|---|---|---|
| 4,875,900 | A * | 10/1989 | Singh et al. | 8/94.27 |
| 5,581,811 | A * | 12/1996 | Cohen et al. | 2/161.7 |
| 5,722,336 | A * | 3/1998 | Takeuchi | 112/441 |
| 5,868,798 | A * | 2/1999 | Anderson et al. | 8/94.15 |
| 5,893,332 | A | 4/1999 | Vourantonis | |
| 5,932,056 | A | 8/1999 | Mark et al. | |
| 6,387,135 | B1 * | 5/2002 | Anderson | 8/94.15 |
| 7,150,763 | B2 * | 12/2006 | Chen | 8/94.12 |
| 7,552,605 | B2 * | 6/2009 | Winkler | 69/21 |

FOREIGN PATENT DOCUMENTS

CN 1492057 9/2003

* cited by examiner

*Primary Examiner* — Tejash Patel
(74) *Attorney, Agent, or Firm* — Fay Sharpe LLP

(57) ABSTRACT

A method for designing and creating material made from fish skins, wherein said material is made from individual fish skins and can be stretched, mechanically or automatically manipulated, sewn, and ironed to ensure that all the unions and surfaces are perfectly uniform, flat, and free of ripples in order to produce a highly-tensile, uniform cloth of variable dimensions. A material includes a plurality of pieces of fish skin, wherein the pieces of fish skin are connected by sewing and/or adhesive. A method of manufacturing a material includes sewing or adhering pieces of fish skin to each other.

14 Claims, 4 Drawing Sheets

5.1 Running stitch
5.2 Extra material of different width folded and ironed in the same direction (the wider edge over the narrower one)

1.1 Individual skin from one side of a fish (1/2 fish)
1.2 Dorsal spine
1.3 Long edges (trimmed/reduced)
1.4 Width 10-14 cm
1.5 Width 4-6 cm 3.1 Running stitch
3.2 Extra material of equal length folded and ironed (one to each side)

2.1 Scale side (exterior)
2.2 Reverse side (interior)
2.3 Distance 5 mm
2.4 Running stitch 5.1 Running stitch
5.2 Extra material of different width folded and ironed in the same direction (the wider edge over the narrower one)

4.1 Scale side (exterior)
4.2 Reverse side (interior)
4.3 Distance 6 mm
4.4 Distance 3 mm
4.5 Running stitch 6.1 Long edges (trimmed/reduced).
6.2 Simple union (adhesive or stitching) on long edges

METHOD FOR DESIGNING AND CREATING MATERIAL MADE FROM FISH SKINS, WHEREIN SAID MATERIAL IS MADE FROM INDIVIDUAL FISH SKINS AND CAN BE STRETCHED, MECHANICALLY OR AUTOMATICALLY MANIPULATED, SEWN, AND IRONED TO ENSURE THAT ALL THE UNIONS AND SURFACES ARE PERFECTLY UNIFORM, FLAT, AND FREE OF RIPPLES IN ORDER TO PRODUCE A HIGHLY-TENSILE, UNIFORM CLOTH OF VARIABLE DIMENSIONS

FIELD OF THE INVENTION

This invention is a type of material crafted from individual fish skins, such as: Atlantic Salmon (Salmo Salar), Rainbow Trout (Oncorhynchus Mykiss), or Coho Salmon (Oncorhynchus Kisutch); which have been previously selected, tanned, processed, and ironed and are later standardized via a system of angled, lineal cuts that have been specially designed to maximize the use of the total area of the individual skins and that combines them to create a large cloth.

The individual fish skins are cut into a rectangular or, preferably, trapezoidal piece (thus maximizing the usable surface of the skin), preferably with the dorsal spine centered within the piece. The resulting trapezoid should have the following measurements: 45-55 cm along the long edges, 10-14 cm along the upper width, and 4-6 cm along the lower width (depending on the orientation of the piece). Each individual piece of skin is connected on its right and left sides (the long edges) to other pieces of skin via the same process: suture with thread and/or a specially designed adhesive. This creates a piece of cloth that, due to the type of cut used for each piece and due to the system implemented to combine them, acts as a single piece of material or large cloth. This characteristic enables said cloth to be used in covering large areas for decorative or functional purposes such as upholstery, wall coverings, clothing, and other similar uses that have not been available until now due to the small size of individual fish skins (see FIG. 1).

It is important to stress that the solution proposed by this application does not currently exist.

BACKGROUND

There have in fact been innovations in the past, but none of these has achieved the effects detailed in this invention.

For example, patent application U.S. Pat. No. 5,932,056 only refers to the creation of a sheet of leather with greater elasticity thanks to the use of an elastic support cloth for use in the manufacture of shoes. It refers to the extraction of pieces of leather from the most elastic and resistant sections, as defined by curved lines that run approximately parallel to the animal's spine, and refers exclusively to cattle and no other animal.

Patent application U.S. Pat. No. 5,893,332 refers to the creation of a cloth from animal skins, whereby the skins are cut into longitudinal shapes and sewn together with alternating pieces of leather (or other material) thus creating a composite of skin and leather that is later cut again and sewn in the same manner, creating squares of alternating skin and leather. Its main application is in the creation of reversible blankets and it does not in any way refer to the use of the skins of specific animals and it makes very general claims.

Lastly, patent application CN1492057 refers to the tanning of fish skins; in this instance they utilize an acrylic resin. The invention details a series of ironing processes to disseminate the dye and the agents used to provide sheen and waterproofing to improve the skins finish, but it only refers to individual skins.

SUMMARY

A method for designing and creating material made from fish skins, wherein said material is made from individual fish skins and can be stretched, mechanically or automatically manipulated, sewn, and ironed to ensure that all the unions and surfaces are perfectly uniform, flat, and free of ripples in order to produce a highly-tensile, uniform cloth of variable dimensions.

A material includes a plurality of pieces of fish skin, wherein the pieces of fish skin are connected by sewing and/or adhesive.

A method of manufacturing a material includes sewing or adhering pieces of fish skin to each other.

DETAILED DESCRIPTION

Unlike the previously mentioned applications, this innovation, with its unique design, cuts, and combinations, allows for the skins of the aforementioned fish, which to date could only be utilized as small pieces, to be utilized as a raw material or textile at a completely new scale and geometry (as measured in a lineal distance) and thus enables its application in industries that to date have not benefitted from such application because they require larger pieces of material than those of the actual dimensions of the individual skins of the aforementioned fish (e.g. interior design, upholstery, clothing, etc.). Likewise, due specifically to the type of cut, geometric positioning of the skins, design, softening, and ironing processes the pieces of combined fish skins are very resistant, which makes them ideal for industries such as interior design, upholstery, and clothing.

Figure 1:
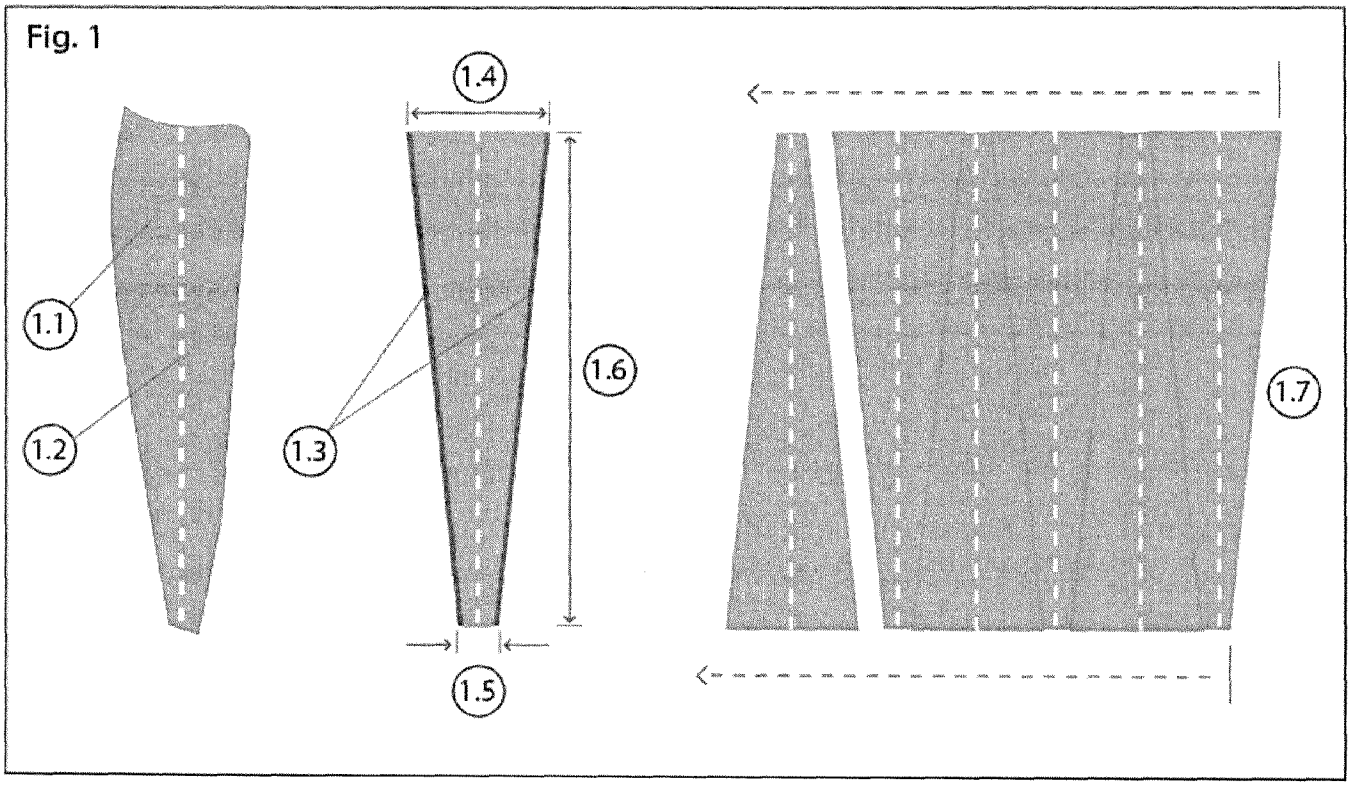
FIGS. 1-6 show fish skin pieces and methods for connecting same in accordance with the present development.

The steps employed in the creation of a piece of material of large dimensions through the process of design, cut, sanding down, and ironing of the individual fish pieces are as follows:

1. Individually tanned and dyed fish skins, are received at the plant;
2. Each skin is then reduced or sanded to standardize the thickness, thus obtaining a homogeneous thickness along each skin and equal to all the other pieces;
3. Each skin is then individually ironed out to avoid any distortion on the surface;
4. Each skin is then cut in such a way as to maximize the surface use (see FIG. 1), eliminate all imperfections along the edges, and leave them completely straight, creating a rectangular or, preferably, trapezoidal piece. This is done by means of a metal template, either using a die cutting tool or manually adjusting the metal template and using a special knife to cut the skin.
5. The long edges of the fish skins are then trimmed down with a special leather-trimming machine (see FIG. 1). The pieces are trimmed down to a preferred thickness on one or both sides in order to reduce the thickness of the union depending on the type of union needed.
6. To unite the pieces and create a large piece of material, the individual skins are positioned side by side (trapezoidal pieces are positioned in alternating directions) with the long edges aligned (see FIG. 1).

To this end, we have developed distinct processes of uniting the pieces that are divided into two categories: double unions and simple unions.

Figure 2:
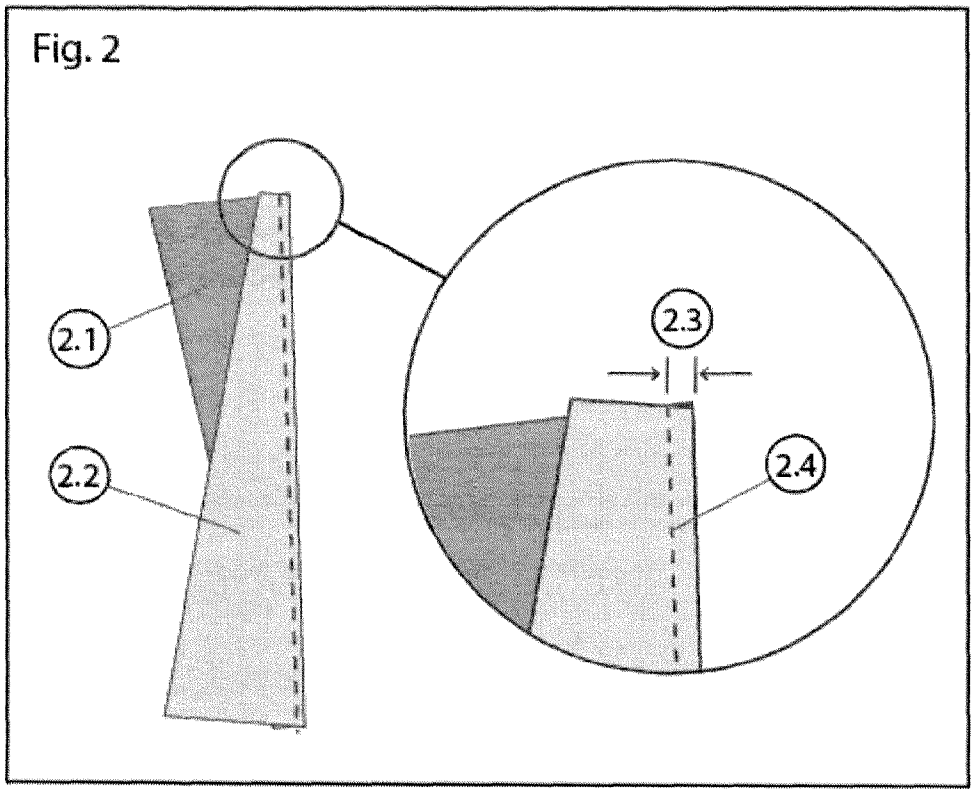
Figure 5:
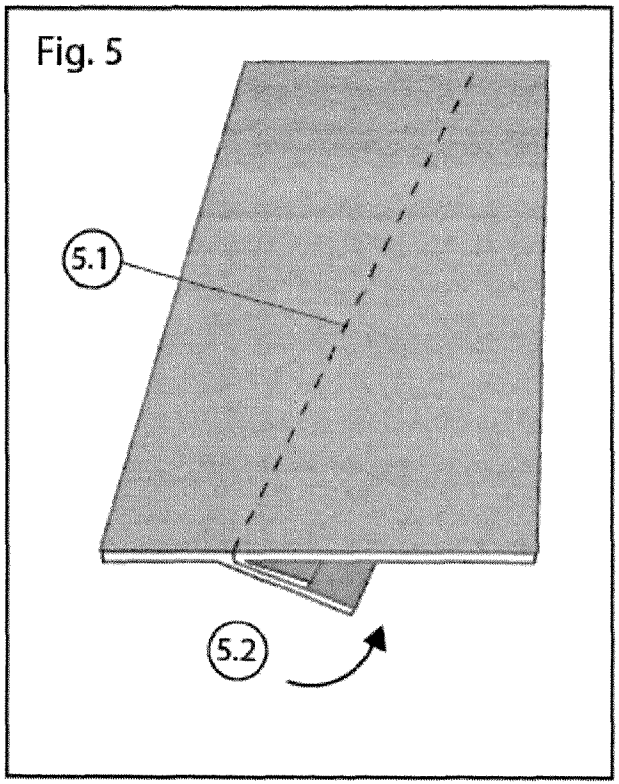

The double union can be of two types (A and B). In both cases the skins are interlaid in such a way that the sides with the scales are touching, aligning the long edges in a parallel way and sewn with a running stitch (see FIG. 2).

Figure 3:
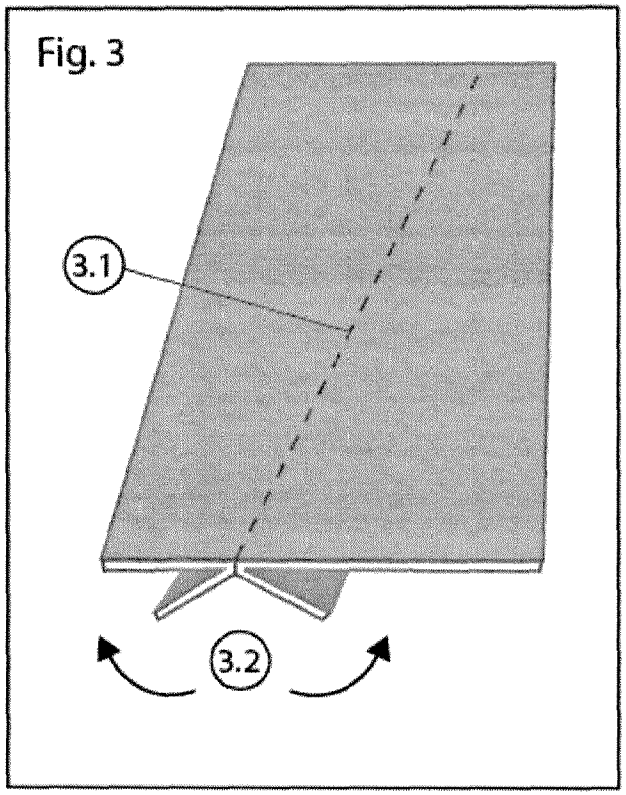

A. Type A aligns the skin edges and sews them together at a preferred distance of 5 mm from the edges leaving an equal amount of extra material that can be folded over on each side, thus creating a union of thread where only the seam unites the two skins into a flat surface (see FIG. 3).

Figure 4:
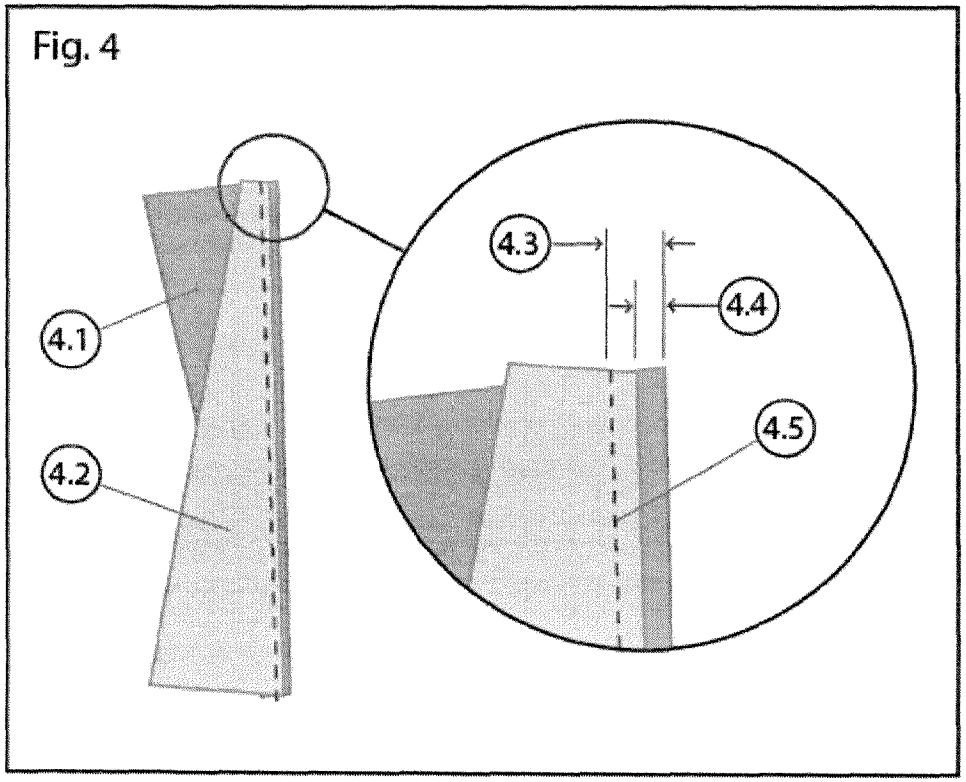

B. Type B aligns the skin edges with a distance of 3 mm from each other and is stitched approximately 6 mm from the first edge (3 mm from the second edge) thus leaving an unequal amount of extra material in each skin that can be folded over together in the same direction (the wider section being folded over the narrower one) creating a fold in the skin and an extremely sturdy union of thread and material. (see FIG. 4)

Following this first union (either type A or B), the stitched skins are opened with the scales on the same side and ironed out in order to stretch the first seam.

The second union ensures that the extra material in both types A and B is flattened and securely fastened. This second union can be made by means of an adhesive on the reverse side (to hide the stitching) or with a second stitching through both sides of the extra material.

With a simple union the skins are aligned with the scales on the same side and the reduced long edges are laid on top of each other creating a completely flat union without any folds whatsoever.

Figure 6:
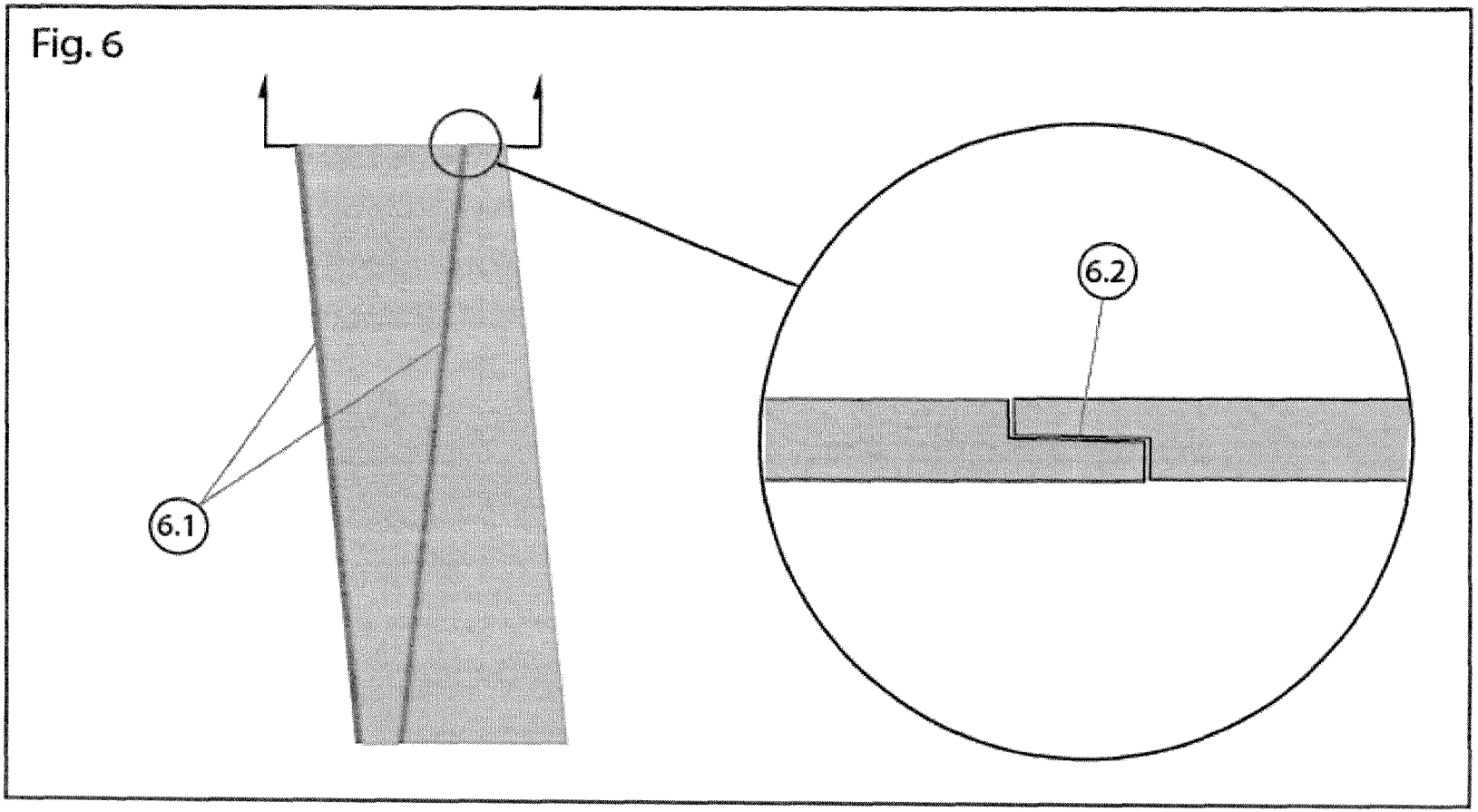

This simple union can be created with an adhesive or by stitching through both pieces of skin (see FIG. 6). This union can also be of two types:

A. Type A utilizes an adhesive along the reduced edges to unite and secure the union.

B. Type B is stitched on the side with the scales (with varied decorative and functional stitches) to secure the union of the skins.

7. Once the piece is united (from various individual pieces) and has the shape of a sheet or large cloth, it is mechanically manipulated and stretched and then ironed out to ensure that all the unions and surfaces are perfectly uniform, flat, and free of ripples.

FIG. 1

1.1 Individual skin from one side of a fish (½ fish)

1.2 Dorsal spine

1.3 Long edges (trimmed/reduced)

1.4 Width 10-14 cm

1.5 Width 4-6 cm

1.6 Length 45-55 cm

1.7 Continuous piece (large skin or cloth) of salmon leather

FIG. 2

2.1 Scale side (exterior)

2.2 Reverse side (interior)

2.3 Distance 5 mm

2.4 Running stitch

FIG. 3

3.1 Running stitch

3.2 Extra material of equal length folded and ironed (one to each side)

FIG. 4

4.1 Scale side (exterior)

4.2 Reverse side (interior)

4.3 Distance 6 mm

4.4 Distance 3 mm

4.5 Running stitch

FIG. 5

5.1 Running stitch

5.2 Extra material of different width folded and ironed in the same direction (the wider edge over the narrower one)

FIG. 6

6.1 Long edges (trimmed/reduced).

6.2 Simple union (adhesive or stitching) on long edges

The invention claimed is:

1. A method for designing and creating material made from fish skins, wherein said material is made from individual fish skins and can be stretched, mechanically or automatically manipulated, sewn, and ironed to ensure that all the unions and surfaces are perfectly uniform, flat, and free of ripples in order to produce a highly-tensile, uniform cloth of variable dimensions.

2. A method for designing and creating material made from fish skins, according to claim 1, wherein the fish skins being utilized in the creation of said material are preferably those of Atlantic Salmon (Salmo Salar), Rainbow Trout (Oncorhynchus Mykiss), and/or Coho Salmon (Oncorhynchus Kisutch).

3. A method for designing and creating material made from fish skins, according to claim 1, wherein the individual fish skins are cut into rectangular or, preferably, trapezoidal pieces with the dorsal spine positioned in the center, wherein the resulting pieces should have the following measurements: 45-55 cm along the long edges, 10-14 cm along the upper width, and 4-6 cm along the lower width depending on the orientation of the piece.

4. A method for designing and creating material made from fish skins, according to claim 1, wherein the fish skins have previously been individually tanned and dyed.

5. A method for designing and creating material made from fish skins, according to claim 3, wherein each skin is trimmed down to remove imperfections and standardize its thickness, thus obtaining a homogeneous thickness among all the pieces.

6. A method for designing and creating material made from fish skins, according to claim 3, wherein each skin is individually ironed out to remove any distortion or imperfection from the surface.

7. A method for designing and creating material made from fish skins, according to claim 3, wherein each skin is individually cut in such a way as to maximize surface usability, eliminating all imperfections along the sides and leaving completely straight edges in the resulting rectangular or, preferably, trapezoidal pieces.

8. A method for designing and creating material made from fish skins, according to claim 3, wherein the long edges of the material have been trimmed down. The pieces are trimmed down to a preferred thickness of 3 to 6 mm on one or both sides depending on the type of union needed.

9. A method for designing and creating material made from fish skins, according to claim 1, wherein this material comprises individual fish skins united by a double union, which can be: a) where the edges of the skins are aligned and sewn preferably 5 mm from the edge leaving two extra pieces of material of equal length that are then folded over to each side creating a union of thread where only the seam unites the two skins resulting in a flat surface; b) the edges of the skins are aligned parallel to each other with a distance of 3 mm and sewn at approximately 6 mm from the first edge (3 mm from the second edge) resulting in an unequal amount of extra material that is folded over in the same direction (the wider section being folded over the narrower one) creating a fold in the skin and an extremely sturdy union of thread and material.

10. A method for designing and creating material made from fish skins, wherein:

said material is made from individual fish skins and can be stretched, mechanically or automatically manipulated, sewn, and ironed to ensure that all the unions and surfaces are uniform, flat, and free of ripples in order to produce a highly-tensile, uniform cloth of variable dimensions;

said material comprises individual fish skins united by a double union, said double union comprising at least one of:

a) a first union where the edges of the skins are aligned and sewn adjacent the edges leaving two pieces of extra material of equal length that are then folded over to each side creating a union of thread where only a first seam unites the two skins resulting in a flat surface;

b) a first union where the edges of the skins are aligned parallel to each other and separated by a distance and where the skins are sewn together at a first seam that is located farther from the edge of one of the skins as compared to the edge of the other of the skins due to said distance, resulting in an unequal amount of extra material;

and wherein following the first union the stitched skins are opened so scales appear on the same side and said stitched skins are ironed out in order to stretch the first seam, said method further comprising making a second union that ensures that the extra material is flattened out and securely fastened, wherein this second union comprises at least one of: (i) an adhesive on a reverse side, (ii) a second stitching through of the extra material.

11. A method for designing and creating material made from fish skins, according to claim 1, wherein this material is composed of individual fish skins united by a simple union created by an adhesive or via stitching through both pieces of skin, wherein this union can also be of two types: a) an adhesive is applied along the trimmed edges to unite and secure the union; b) is stitched on the side with the scales, with varied decorative and functional stitches, to secure the union of the skins.

12. A material comprising a plurality of pieces of fish skin, wherein said pieces of fish skin are connected by sewing and/or adhesive.

13. A method of manufacturing a material from a plurality of separate fish skins, said method comprising:

processing a plurality of separate fish skins such that each fish skin has a homogeneous thickness that is substantially the same as each other fish skin;

cutting each fish skin along its edges to define straight edges on each fish skin;

positioning separate fish skins adjacent to each other along their respective straight edges and sewing or adhering the pieces of fish skin to each other.

14. The method as set forth in claim 13, wherein said step of cutting each fish skin along its edges to define straight edges on each fish skin comprises cutting said fish skins into a trapezoidal shape.

* * * * *